United States Patent [19]

Onaka et al.

[11] Patent Number: 4,482,508

[45] Date of Patent: Nov. 13, 1984

[54] ALTITUDE COMPENSATION DEVICE FOR INTERNAL COMBUSTION ENGINE

[75] Inventors: Hidemi Onaka; Mamoru Yoshioka, both of Susono, Japan

[73] Assignee: Toyota Jidosha Kobushiki Kaisha, Japan

[21] Appl. No.: 451,782

[22] Filed: Dec. 21, 1982

[51] Int. Cl.[3] ..... F02M 1/14

[52] U.S. Cl. ..... 261/39 A; 261/64 C; 261/64 E

[58] Field of Search ..... 261/64 E, 64 C, 39 A

[56] References Cited

U.S. PATENT DOCUMENTS

| | | | |
|---|---|---|---|
| 3,789,814 | 2/1974 | Gillham et al. | 261/39 C |
| 4,005,161 | 1/1977 | Shimo et al. | 261/52 |

FOREIGN PATENT DOCUMENTS

| | | | |
|---|---|---|---|
| 47-27530 | 7/1972 | Japan | 261/64 C |
| 53-11238 | 2/1978 | Japan | 261/39 A |
| 55-32971 | 7/1980 | Japan | 261/64 E |
| 55-35171 | 12/1980 | Japan | 261/39 A |

*Primary Examiner*—Tim Miles

*Attorney, Agent, or Firm*—Parkhurst & Oliff

[57] ABSTRACT

An altitude compensation device for internal combustion engines such as automotive engines. The device has a first diaphragm device and a second diaphragm device which are provided with a first diaphragm chamber and a second diaphragm chamber defined by a first diaphragm and a second diaphragm, respectively. A choke lever connected to a choke valve is fixed to the first diaphragm while a stopper for limiting the opening of the choke valve is provided on the second diaphragm device. A first communication passage provides a communication between the first diaphragm chamber and the intake passage of the engine so as to transmit the intake vacuum to the first diaphragm chamber to drive the choke valve in such a direction as to open the choke valve. A second communication passage provides a communication between the intake passage and the second diaphragm chamber to transmit the intake vacuum thereby to move the stopper in such a direction as to afford a larger opening of the choke valve. An air bleed valve is disposed in the second communication passage to selectively bring the latter into communication with the atmosphere.

4 Claims, 4 Drawing Figures

ALTITUDE COMPENSATION DEVICE FOR INTERNAL COMBUSTION ENGINE

BACKGROUND OF THE INVENTION

The present invention relates to an altitude compensation device for internal combustion engines, and more particularly to an altitude compensation device for compensating for an air-fuel ratio of a mixture to be introduced into the engine in accordance with a change of an altitude of the engine.

A known system for controlling a choke valve in the internal combustion engine incorporates a diaphragm serving as an actuator for actuating the choke valve. The diaphragm defines one major wall of a diaphragm chamber which is communicated with an intake pipe of the engine through the intake passage. As the vacuum in the intake passage is increased, the diaphragm is deflected to increase the opening degree of the choke valve. In this choke valve control system, however, the operation characteristic of the diaphragm is not changed even when the altitude of the engine is changed. This causes a problem as follows. Namely, assuming here that the altitude of the engine is increased, the level of the intake vacuum is lowered naturally to reduce the force of the actuator so that the choke valve is held at an opening degree which is smaller than the required one, so that the air-fuel mixture is made excessively rich undesirably resulting in an increase of noxious exhaust emissions and deterioration of the engine performance.

SUMMARY OF THE INVENTION

Accordingly, it is a primary object of the invention to provide an altitude compensation device for internal combustion engines, capable of preventing excessive enrichment of air-fuel mixture at a high altitude, thereby to obviate the above-described problems of the prior art.

To this end, according to the invention, there is provided an altitude compensation device for internal combustion engines comprising: a first diaphragm means having a first diaphragm chamber defined by a first diaphragm; a second diaphragm means having a second diaphragm chamber defined by a second diaphragm; a choke lever fixed to the first diaphragm; a stopper portion on the second diaphragm device and adapted to limit the opening degree of the choke valve; a first resilient member accomodated by the first diaphragm chamber and adapted to bias the choke lever in such a direction as to close the choke valve; a second resilient member accomodated by the second diaphragm chamber and adapted to bias the stopper portion in such a direction as to reduce the opening degree of the choke valve; a first communication passage providing a communication between the first diaphragm chamber and an intake passage so as to transmit the intake vacuum in the intake passage to move the choke lever in such a direction as to open the choke valve overcoming the force of the first resilient member; a second communication passage providing a communication between the second diaphragm chamber and the intake passage so as to transmit the intake vacuum in the intake passage to move the stopper portion overcoming the force of the second resilient member; and an air bleed valve disposed in the second communication passage and adapted to permit the second communication passage to communicate with the atmosphere at low altitude and to break the communication between the second passage and the atmopshere at high altitude.

Other objects, features and advantages of the invention will become clear from the following description of the preferred embodiment taken in conjunction with the accompanying drawings.

BRIEF DESCRIPTION OF THE INVENTION

DESCRIPTION OF THE PREFERRED EMBODIMENT

A preferred embodiment of the invention will be described hereinunder with reference to the accompanying drawings.

Figure 1:
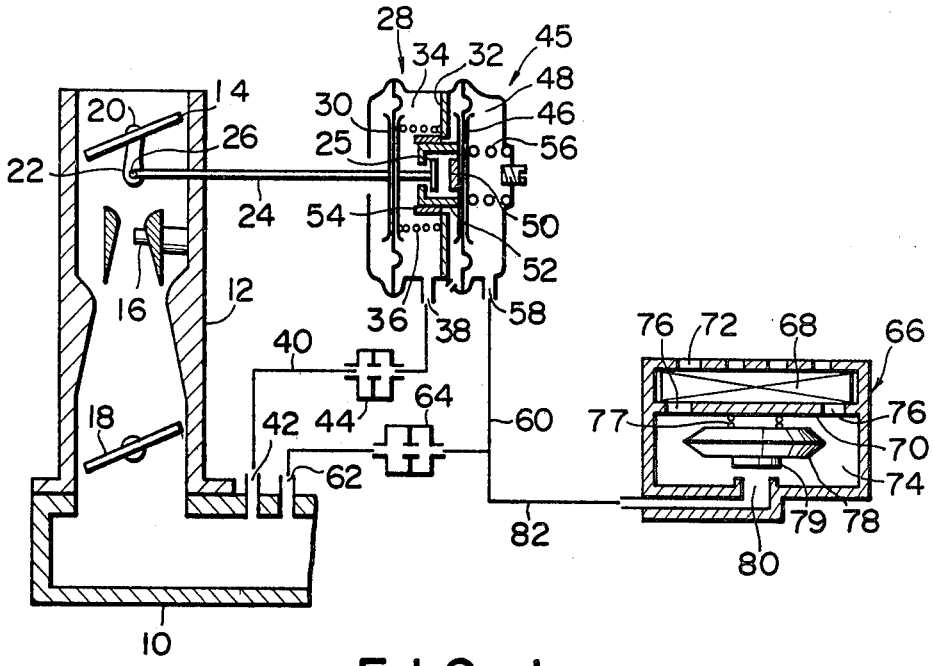
FIG. 1 is a sectional view of the whole part of an altitude compensation device in accordance with the invention.

Referring first to FIG. 1, an air cleaner (not shown) is connected to the upstream-side end of an intake pipe 10 as viewed in the direction of flow of the intake air. A carburetor 12 is connected in the intake pipe 10 at a portion of the latter downstream from the air cleaner. As is well known, the carburetor 12 is composed of parts such as a choke valve 14, fuel nozzle 16, throttle valve 18 and so forth. The choke valve 14 is carried by a valve shaft 20 provided with a projection 22. A choke lever 24 is pivotally connected to the projection 22 through a pin 26. The other end of the choke lever 24 is fixed to a first diaphragm 30 of a first diaphragm device 28, so that the choke lever 24 is moved following up the movement of the first diaphragm 30. The first diaphragm device 28 has a partition plate 32 which, in cooperation with the first diaphragm 30, defines a first diaphragm chamber 34 accomodating a first spring 36. The first spring 36 biases the choke lever 24 in such a direction as to close the choke valve 14, i.e. to the left as viewed in the drawing. The first diaphragm chamber 34 is provided with a port 38 which is connected through a first communication passage 40 to a port 42 opening to the intake pipe 10 of an engine. Therefore, as the intake vacuum generated in the intake pipe 10 is transmitted to the first diaphragm chamber 34, the choke lever 24 is moved to the right, i.e. in the direction for opening the choke valve 14. The first communication passage 40 is provided with a restriction 42 which serves to delay the transmission of the vacuum from the intake pipe 10 into the first diaphragm chamber 34.

A second diaphragm 45 is disposed adjacent to the first diaphragm device 28. The second diaphragm device 45 has a second diaphragm 46 which defines a second diaphragm chamber 48.

A stopper portion 50 is formed on the side of the second diaphragm 46 adjacent to the first diaphragm chamber 34 so as to oppose to an end 25 of the choke lever 24. The second diaphragm 46 is further provided with a cylindrical portion 52 surrounding the stopper portion 50 and the end 25 of the choke lever 24. This cylindrical portion 52 is disposed in a guide sleeve 54 provided on the partition plate 32 and is slidable along and within the guide sleeve 54. A spring 56 disposed in the second diaphragm chamber 48 is adapted to bias the second diaphragm 46 and, in turn, the stopper portion 50 towards the end 25 of the choke lever 24. Furthermore, a port 58 opening to the second diaphragm chamber 48 is communicated with a port 62 opening to the intake pipe 10 through a second communication passage 60 so as to permit the transmission of the intake vacuum from the intake passage in the pipe 10 to the second diaphragm chamber 48. The communication passage 60 is provided with a restriction 64 which serves to delay the transmission of the vacuum from the intake passage to the second diaphragm chamber 48.

The second communication passage 60 is provided with an air bleed valve 66 which has a construction detailed hereinunder. The air bleed valve 66 is provided at its upper portion with a partition plate 70 defining a filter chamber accomodating a filter 68 which is communicated with the atmosphere through numerous fine apertures 72. A chamber 74 defined at the lower side of the partition plate 70 is communicated with the filter chamber through communication holes 76 formed in the partition plate 70. A bellows 78 accomodated by the chamber 74 is secured to the lower side of the partition plate 70 through a spring 77. The bellows 78 is adapted to contract and expand in accordance with the change in the atmospheric pressure so as to close and open an outlet port 80 of the air bleed valve 66. The outlet port 80 is communicated with the second passage 60 through a passage 82.

The altitude compensation device of the described embodiment operates in a manner explained hereinbelow.

When the automobile mounting an engine provided with the altitude compensation device runs at a low altitude such as on level land, the bellows 78 of the air bleed valve 66 is contracted by the atmospheric pressure to open the outlet port 80 as shown in FIG. 1. As a result, the second communication passage 60, which transmits the intake vacuum to the second diaphragm chamber, is supplied with air so as to weaken the vacuum force acting in the second diaphragm 48. Consequently, the stopper portion 50 is located by the biasing force of the spring 56 so as to take a position adjacent to the end 25 of the choke lever 24. Meanwhile, the intake vacuum is transmitted to the first diaphragm chamber 34 through the first communication passage 40 to cause a movement of the choke lever 24 in such a direction as to open the choke valve 14. This movement, however, is limited by the stopper portion 50 so that the choke valve 14 is held at a comparatively small opening suitable for engine operation at a low altitude.

Figure 2:
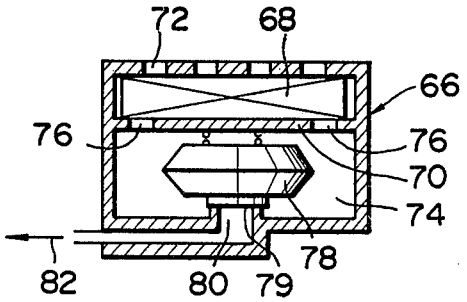
FIG. 2 is a sectional view of an essential part of the altitude compensation device shown in FIG. 1.

In contrast, during running of the automobile at a high altitude, the bellows 78 of the air bleed valve 66 is expanded as a result of reduction in the atmospheric pressure so that the outlet port 80 is closed by the lower end 79 of the bellows 78 as shown in FIG. 2. In this state, bleed air can no more be supplied to the second communication pasage 60. As a result, the intake vacuum solely acts in the second diaphragm chamber 48 so that the second diaphragm 46 is moved to the right overcoming the force of the spring 56, so that the stopper portion 50 is moved away from the end 25 of the choke lever 24. This rightward movement of the stopper 50 increases the allowance for the rightward movement of the choke lever 24. As a result, the choke valve 14 is held at a greater opening degree during running at a high altitude than at a low altitude running. The undesirable enrichment of the air-fuel mixture at a high altitude is avoided advantageously.

Figure 4:
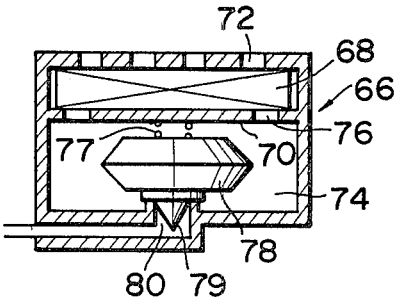
FIG. 4 is a sectional view of an essential part of the altitude compensation device shown in FIG. 3.
Figure 3:
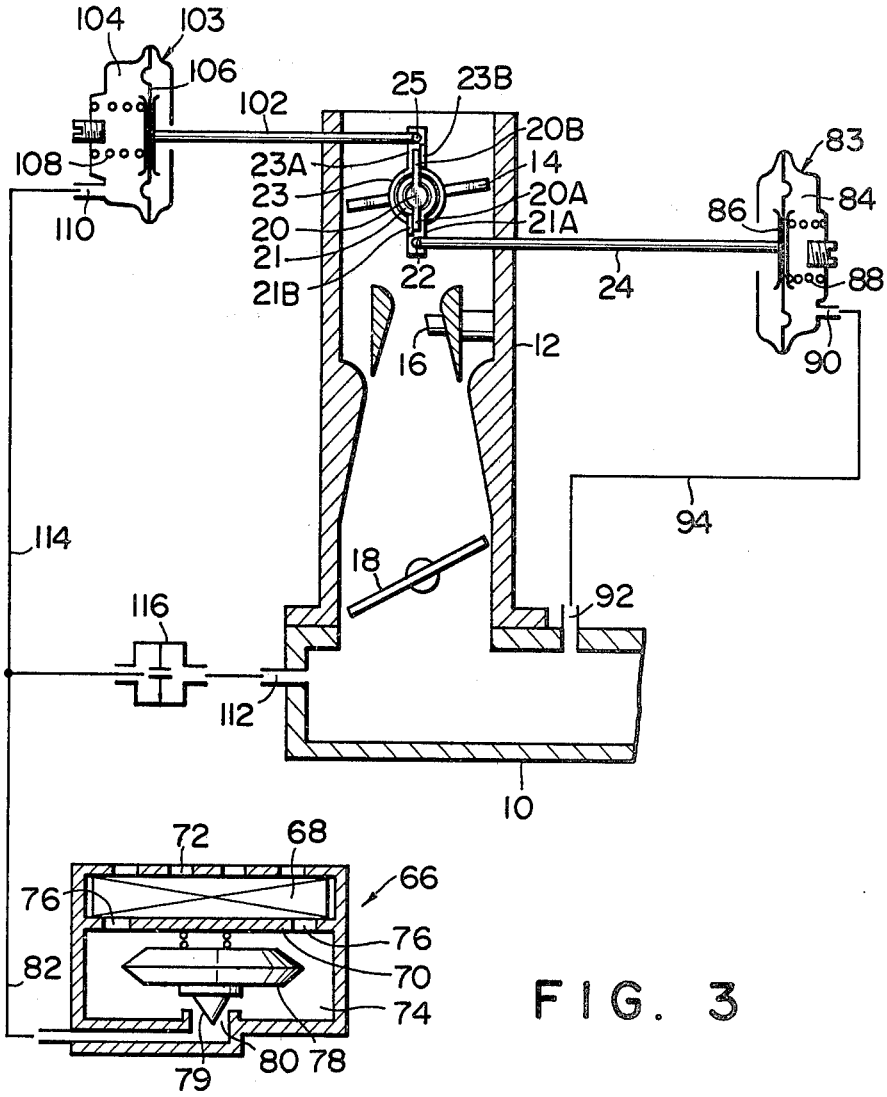
FIG. 3 is a sectional view of the whole part of an altitude compensation device in accordance with another embodiment of the invention.

FIGS. 3 and 4 show an altitude compensation device in accordance with a second embodiment of the invention. Unlike the first embodiment in which the first diaphragm device 28 and the second diaphragm device are constructed as a unit, the first diaphragm device and the second diaphragm device are constructed separately in the second embodiment. More specifically, the choke lever 24 is connected at its right end to a first diaphragm 86 of a first diaphragm device 83. A first spring 88 disposed in a first diaphragm chamber 84 defined by the first diaphragm 86, and is adapted to bias the choke lever 24 to the left.

The choke valve 14 is carried by a valve shaft 20 which is provided on its periphery with two projections 20A,20B arranged at 180° interval. The valve shaft 20 pivotally carries a cylindrical body 21 therearound having an arm 21A. The choke lever 24 is pivotally connected at its left end to the arm 21A through a pin 22. The arm 21A is further provided with a retainer portion 21B positioned at the left side of the projection 20A and contactable with the latter.

A port 90 opening to the first diaphragm chamber 84 is communicated through a first communication passage 94 with a port 92 opening to the intake pipe 10. Therefore, as the intake vacuum generated in the intake pipe 10 is transmitted to the diaphragm chamber 84 to act in the latter, the choke lever 24 is moved to the right overcoming the biasing force of the spring 88. The rightward movement of the choke lever 24 causes the arm 21A to rotate counter-clockwise while keeping its retainer portion 21B in contact with the projection 20A, thereby to open the choke valve 14.

The valve shaft 20 also carries a cylindrical member 23 outside the cylindrical member 21. The cylindrical member 23 is provided with an arm 23A to which pivotally secured through a pin 25 is the right end of a choke lever 102. Furthermore, the arm 23A is provided with a retainer portion 23B positioned at the right side of the projection 20B and contactable with the latter. Therefore, as the lever 102 is moved to the left, the arm 23A is rotated counter-clockwise with the retainer portion 23B held in contact with the projection 20B thereby to open the choke valve 14.

The choke lever 102 is connected at its left end to a second diaphragm 106 of a second diaphragm device 103. The second diaphragm 106 defines a second diaphragm chamber 104 accomodating a spring 108 which acts to bias the choke lever 102 rightwardly, i.e. in such a direction as to move the retainer portion 23B away from the projection 20B. A port 110 opening to the second diaphragm chamber 104 is communicated through a second communication passage 114 with a port 112 opening to the intake pipe 10. Therefore, as the intake vacuum in the intake pipe 10 is transmitted to the second diaphragm chamber to act in the latter, the choke lever 102 is moved to the left overcoming the biasing force of the spring 108. As a result, the arm 23A is rotated counter-clockwise thereby to open the choke valve 14. A restriction 116 provided in the second communication passage 114 serves to delay the transmission of the vacuum from the intake pipe 10 to the second diaphragm chamber 104.

As in the case of the first embodiment, an air bleed valve is provided in the second communication passage 114. This air bleed valve has a construction as shown in FIG. 3, substantially identical to that of the first embodiment shown in FIG. 1. In FIG. 3, therefore, the same reference numerals are used to denote the same parts or members as those shown in FIG. 1, and detailed description of such parts or members is omitted here.

The air bleed valve 66 of the second embodiment is discriminated from that 66 in the first embodiment only by the fact that the lower end 79 of the bellows 78 is shaped in a conical form. Therefore, in this second embodiment, the opening degree of the outlet port 80 is changed progressively in accordance with a change in the position of the lower end 79 of the bellows 78, unlike the first embodiment in which the opening of the outlet port 80 is controlled in an on-off fashion. As in the case of the first embodiment, the outlet port 80 of the air bleed valve of this embodiment is connected to the second communication passage 114 through a passage 82 so that the second communication passage 114 is adapted to be supplied with bleed air through the air bleed valve 66.

In the operation of the altitude compensation device of the second embodiment, when the altitude of the engine is low as on a level land, the bellows 78 is contracted to keep the outlet port 80 open as shown in FIG. 3, so that bleed air is supplied to the second communication passage 114 which transmits the intake vacuum, thereby to weaken the vacuum force acting in the second diaphragm chamber 104. In this state, the position of the choke lever 102 is ruled mainly by the resilient force of the spring 108 and the retainer portion 23B of the arm 23A is moved away from the projection 20B. Therefore, during running at a low altitude, the opening degree of the choke valve 14 is under the control by the first diaphragm device 83.

In contrast, when the automobile runs at a high altitude, the bellows 78 is expanded to close the outlet port 80 at its lower end as shown in FIG. 4, as a result of reduction in the atmospheric pressure. As a result, the supply of the bleed air to the second communication passage 114 is ceased so that the intake vacuum transmitted from the intake pipe 10 solely acts in the second diaphragm chamber 104. In consequence, the choke lever 102 is moved to the left by the force of the intake vacuum overcoming the force of the spring 108. The leftward movement of the lever 102 causes a counterclockwise rotation of the arm 23A so that the retainer portion 23B comes into contact with the projection 20B to increase the opening degree of the choke valve 14. Thus, the choke valve 14 can have a larger opening degree at high altitude than at low altitude, so that the undesirable enrichment of air-fuel mixture at high altitude is avoided advantageously.

In the second embodiment described hereinbefore, the lower end 79 of the bellows 78 is shaped in a conical form, so that the opening area of the outlet port 80 is progressively decreased as the bellows expands gradually in accordance with the increase in the altitude, so that the vacuum force acting in the second diaphragm chamber 104 and, hence, the position of retaining portion 23B of the arm 23A are changed linearly in accordance with the change in the altitude.

As has been described, according to the altitude compensation device of engine in accordance with the invention, a larger choke valve opening is provided at a high altitude than at a low altitude to effectively prevent excessive enrichment of air-fuel mixture thereby to ensure a smooth engine operation while avoiding any increase of noxious exhaust emission and deterioration of performance in the engine operation at a high altitude.

Although the invention has been described through specific terms, it is to be noted here that the described embodiments are only illustrative and various changes and modifications may be imparted thereto without departing from the scope of the invention which is limited solely by the appended claims.

What is claimed is:

1. An altitude compensation device for an internal combustion engine for controlling an opening degree of a choke valve in accordance with a change of an altitude of the engine, comprising:

first diaphragm means for progressively opening the choke valve as a vacuum pressure from an intake passage increases, said first diaphragm means comprising:

a first diaphragm connected to the choke valve;

a first diaphragm chamber defined by said first diaphragm and communicated with the intake passage to introduce the vacuum pressure in the intake passage into said first diaphragm chamber, said vacuum pressure biasing said first diaphragm to move in such a direction as to open the choke valve; and a first spring accomodated in said first diaphragm chamber and biasing said first diaphragm to move in such a direction as to close the choke valve;

second diaphragm means for progressively opening the choke valve as the vacuum pressure from the intake passage increases, said second diaphragm means comprising:

a second diaphragm connected to the choke valve;

a second diaphragm chamber defined by said second diaphragm and communicated with the intake passage to introduce the vacuum pressure in the intake passage into said second diaphragm chamber, said vacuum pressure biasing said second diaphragm to move in such a direction as to open the choke valve; and a second spring accomodated in said second diaphragm chamber to move in such a direction as to close the choke valve;

air bleed means for compensating the vacuum pressure to be introduced to said second diaphragm means with the atmospheric pressure when the engine is at less than a pre-determined altitude;

first and second arms projecting from a rotational axis of the choke valve;

a first choke lever connecting said first arm and said first diaphragm; and a second choke lever connecting said second arm and said second diaphragm.

2. An altitude compensation device as set forth in claim 1, wherein said air bleed means comprises:

a chamber communicated with the atmosphere;

an outlet port providing a communication between said chamber and said second diaphragm chamber to compensate the vacuum pressure to be introduced into said secnd diaphragm chamber with the atmospheric pressure; and a bellows accomodated in said chamber and being expandable to shut off said outlet port when the atmospheric pressure is lower than a predetermined value.

3. An altitude compensation device as set forth in claim 2, wherein said air bleed means further comprises restriction means for progressively restricting an opening of said outlet port as said bellows expands.

4. An altitude compensation device as set forth in claim 3, wherein said restriction means comprises a conically shaped end of said bellows opposed to said outlet port.

* * * * *